US008948431B2

(12) United States Patent
Zamir et al.

(10) Patent No.: US 8,948,431 B2
(45) Date of Patent: Feb. 3, 2015

(54) METHOD AND APPARATUS FOR CONTROLLING AN ELECTRONIC SYSTEM

(75) Inventors: Lee Zamir, Cambridge, MA (US); Laszlo Otto Drimusz, Framingham, MA (US)

(73) Assignee: Bose Corporation, Framingham, MA (US)

( * ) Notice: Subject to any disclaimer, the term of this patent is extended or adjusted under 35 U.S.C. 154(b) by 1280 days.

(21) Appl. No.: 12/640,544

(22) Filed: Dec. 17, 2009

(65) Prior Publication Data

US 2011/0149170 A1 Jun. 23, 2011

(51) Int. Cl.

| | |
|---|---|
| ***H04R 1/02*** | (2006.01) |
| ***H04R 9/06*** | (2006.01) |
| ***G08C 23/04*** | (2006.01) |
| *H04R 27/00* | (2006.01) |

(52) U.S. Cl.

CPC ..... *G08C 23/04* (2013.01); *G08C 2201/40* (2013.01); *G08C 2201/92* (2013.01); *H04R 27/00* (2013.01); *H04R 2420/07* (2013.01)

USPC ..... 381/333; 381/104; 381/388; 348/734; 340/12.22; 398/39; 398/106

(58) Field of Classification Search

USPC ..... 381/333, 107, 104, 386, 388, 105; 341/173, 176; 348/14.05, 739, 14.01, 348/734, 725, 705, 706; 340/12.22; 398/39, 398/107, 108, 106

See application file for complete search history.

(56) References Cited

U.S. PATENT DOCUMENTS

| | | | | |
|---|---|---|---|---|
| 4,972,503 | A | 11/1990 | Zurlinden | |
| 5,113,438 | A | 5/1992 | Blokker, Jr. et al. | |
| 5,808,703 | A * | 9/1998 | Karlqvist | 348/734 |
| 2004/0181301 | A1 | 9/2004 | Kimura et al. | |
| 2008/0136972 | A1 | 6/2008 | Blankenburg | |
| 2008/0152110 | A1 * | 6/2008 | Underwood et al. | 379/142.16 |
| 2009/0046210 | A1 * | 2/2009 | Sakamoto et al. | 348/738 |

FOREIGN PATENT DOCUMENTS

EP 1947843 A1 7/2008

OTHER PUBLICATIONS

Invitation to Pay Addiitional Fees and, Where Applicable, Protest Fee, dated Mar. 1, 2011, 7 pages for PCT/US2010/058892.

International Search Report and Written Opinion dated Apr. 7, 2011 for Int. Appln. No. PCT/US10/058892.

International Preliminary Report on Patentability dated Jun. 28, 2012 for International application No. PCT/US2010/058892.

* cited by examiner

*Primary Examiner* — Vivian Chin
*Assistant Examiner* — Con P Tran

(57) ABSTRACT

According to a first aspect, a method of controlling an electronic system includes the step of receiving by a first device a plurality of receivable wireless signals that are intended to control functions of a second device. The first device transmits a wireless signal that prevents a subset of the plurality of receivable wireless signals from controlling the second device.

14 Claims, 6 Drawing Sheets

METHOD AND APPARATUS FOR CONTROLLING AN ELECTRONIC SYSTEM

BACKGROUND

Modern home theatre systems typically include a number of components such as a TV, a cable and/or satellite set top box, a DVD player and an audio/video receiver. These components are often purchased separately and usually each come with their own remote control. Having a number of remote controls causes clutter and increases the complexity of controlling the system which can be confusing for the user. One of these remote controls or a separately purchased universal remote control may be programmed to control most or all of the functions of the various components in the home theatre system. This can allow the user to use a single remote control which can reduce the clutter and confusion mentioned above. However, having to program a remote control can be a tedious, frustrating and time consuming task for a user.

Further, home theatre systems usually include additional speakers which are used in place of the integrated speakers in the TV. If audio is being played over both the additional speakers and integrated speakers, poor quality audio reproduction can result due to uncontrolled combination of sound output from the integrated speakers and sound output by the additional home theater speakers. For example, a slight delay can arise between the output of the two audio systems because of signal processing differences, which can result in frequency response degradation.

SUMMARY

According to a first aspect, a method of controlling an electronic system includes the step of receiving by a first device a plurality of receivable wireless signals that are intended to control functions of a second device. The first device transmits a wireless signal that prevents a subset of the plurality of receivable wireless signals from controlling the second device.

The plurality of receivable wireless signals can be infrared signals. The wireless signal can be an infrared signal. Information in the subset of the plurality of receivable wireless signals can be utilized to change a sound level output from one or more acoustic drivers that are not integrated into the second device. A sound level output by one or more acoustic drivers that are integrated into the second device can be automatically lowered. One of the subset of the plurality of receivable wireless signals can be used in controlling a function of the first device. The lowering step can be done before the receiving and transmitting steps.

An apparatus for controlling an electronic system includes a receiver of a first device for receiving a plurality of receivable wireless signals that are intended to control functions of a second device. A transmitter of the first device for transmitting a wireless signal that prevents a subset of the plurality of receivable wireless signals from controlling the second device.

The plurality of receivable wireless signals can be an infrared signals. The wireless signal from the transmitter can be an infrared signal. A controller can be included which utilizes information in one of the subset of the plurality of receivable wireless signals to change a sound level output from one or more acoustic drivers that are not integrated into the second device. A controller can be included which automatically lowers a sound level output by one or more acoustic drivers that are integrated into the second device. The apparatus can be for controlling sound level in an audio/video system, wherein one of the receivable wireless signals are intended to change a sound level output by one or more acoustic drivers that are integrated into a video display device, and wherein the wireless signal from the transmitter prevents the one of the receivable wireless signals from changing the sound level output by the one or more acoustic drivers that are integrated into the video display device. The lowering of the sound level output by the one or more acoustic drivers that are integrated into the second device can be done before the receiver receives any of the plurality of receivable wireless signals. The lowering of the sound level output by the one or more acoustic drivers that are integrated into the second device can be done before the transmitter transmits the second wireless signal.

A method of controlling sound level in an audio/video system, includes the step of determining that a video display device with one or more integrated acoustic drivers has been powered on. A sound level output by the one or more integrated acoustic drivers is automatically lowered when a supplemental audio system with one or more additional acoustic drivers is being used to provide sound related to video information being presented on the display.

The sound level output by the one or more acoustic drivers that are integrated into the video display device can automatically lowered to a lowest level. A first wireless signal can be received by a wireless receiver that is intended to change the sound level output by the one or more acoustic drivers that are integrated into the video display device. A second wireless signal can be transmitted that prevents the first wireless signal from changing the sound level output by the one or more acoustic drivers that are integrated into the video display device. The first wireless signal can be an infrared signal. The second wireless signal can be an infrared signal. Information in the first wireless signal can be utilized to change a sound level output from one or more of the additional acoustic drivers in the supplemental audio system. The lowering step can be done before the receiving and transmitting steps. The lowering step can use a wireless signal to cause the sound level output by one or more acoustic drivers that are integrated into the video display device to be lowered. The second device can be a video display device. Information in the subset of the plurality of receivable wireless signals can be utilized to change an audio/video input to the first device.

DETAILED DESCRIPTION

Many consumers choose to add a supplemental speaker system for use with their television display to provide enhanced audio reproduction while watching a video program on their video display. The disclosure below discusses allowing the user to use the remote control they already use for controlling their TV to hijack certain commands sent by the remote and implement them on the supplemental system rather than the television display.

When there are two independent audio reproduction systems, their characteristics can have uncontrolled relationships to each other affecting overall sound quality. Also, there is additional complexity in the system as both audio systems have controls to be operated independently. It is desirable for it to appear to the user, when the supplemental audio system is added to the television display, that the combined audio systems function in the same the manner that the user expects the integrated audio reproduction system of the television to function when there is no supplemental audio system present. The audio performance obtained from the supplemental system should not be detrimentally affected by the integrated audio system. Additionally, UI information from the display should not contradict in any way actions taken by the user. For example, when actuating the volume control of the display remote, if that control is used by the invention to change the volume of external speakers, the display should not display "mute", "speakers off", or any other message that would confuse the user.

Figure 1:
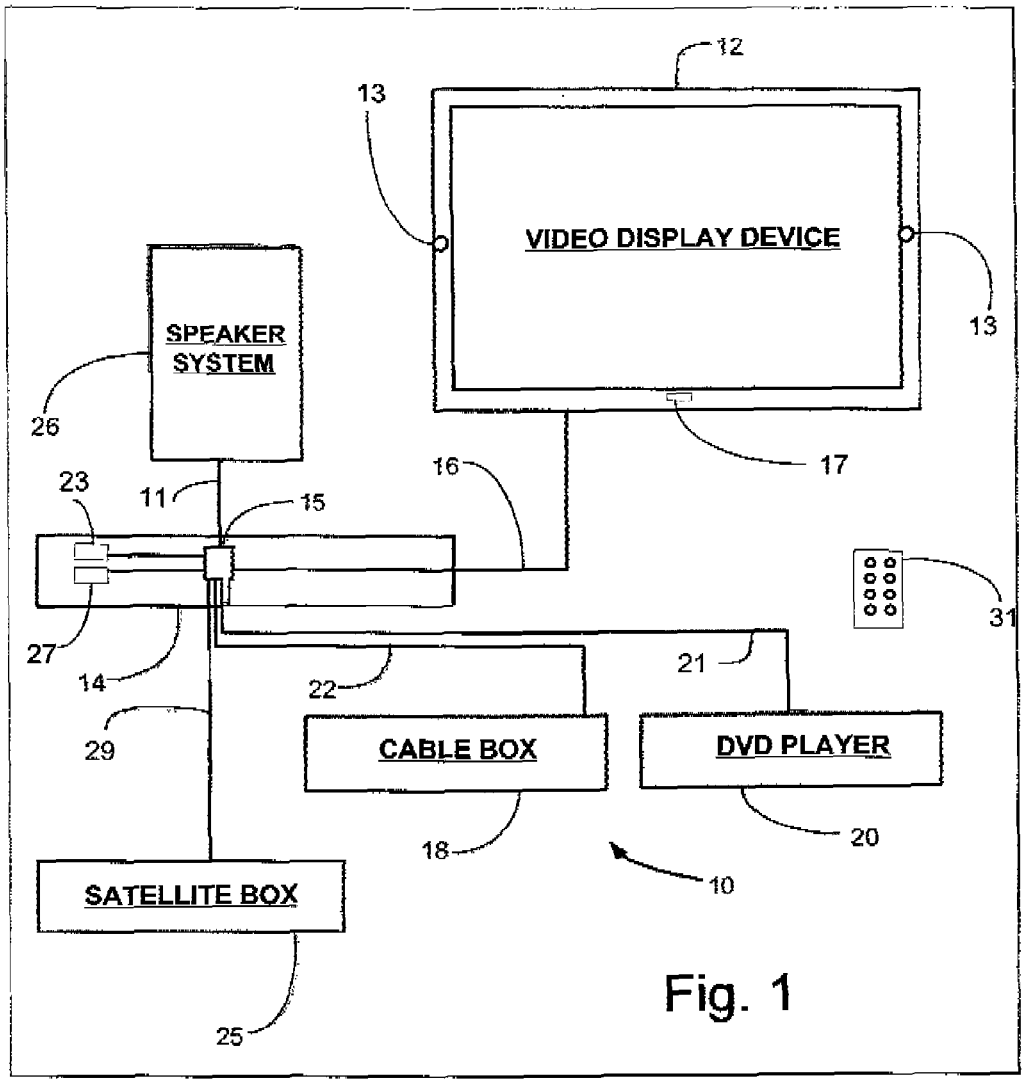
FIG. 1 is a schematic representation of an audio video system.

FIG. 1 discloses an audio/video system 10 which includes a video display device 12 such as a liquid crystal or plasma display. The display 12 includes integrated speakers (acoustic drivers) 13 and an infra-red (IR) receiver 17. An audio/video receiver 14 is connected to the video display device 12 by, for example, a High Definition Multimedia Interface (HDMI) cable 16. Alternatively, a separate stereo audio cable pair along with a component, composite or s-video connection may be used in place of the HDMI cable 16. As such, audio and video images from the receiver 14 can respectively be presented by the speakers 13 and on the display 12. The receiver 14 also includes an IR receiver 23 and an IR transmitter 27. Although not necessarily shown in FIG. 1, it is preferable that IR receivers 17 and 23 are spaced relatively close to each other and oriented in the same direction A pair of audio/video devices, such as a cable box 18 and a digital video disc (DVD) player 20, are attached to the receiver 14 by, for example, respective HDMI cables 22 and 21. An additional audio video device, such as a satellite box 25, is connected to the receiver 14 by, for example, an HDMI cable 29. A supplemental speaker system 26 is connected to receiver 14 by a cable 11. The supplemental speaker system 26 can be any of a number of such systems including 7.2 (seven surround speakers and two base boxes), 7.1, 5.1 (five surround speakers and 1 bass box), 2.1, 1.1 (a "sound bar" with one bass box) and 1.0. During initial setup of the supplemental speaker system 26, the user is instructed to turn off the integrated speakers 13 of the display 12. Alternatively, the user can be instructed to set the speakers 13 to a lowest volume setting or to mute the speakers.

The receiver 14 includes a controller 15 which interfaces with the display 12, the supplemental speaker system 26, and the audio/video devices 18, 20 and 25. The controller is a microprocessor with associated memory and that runs software to perform functions such as audio and video decoding, electrical power control, signal processing, etc. The controller 15 controls operation of the receiver 14. A wireless remote control 31, associated with video display 12, can issue wireless signals for controlling operation of the video display 12. For ease of discussion, the specification describes one method of wireless communication between remote 31, receiver 14 and display 12 as being IR. However, it should be understood that any means of wireless communication between these devices is contemplated here (such as IR, RF, etc. using any known modulation method for encoding information), and the invention is not limited to use with any one particular method.

Figure 2:
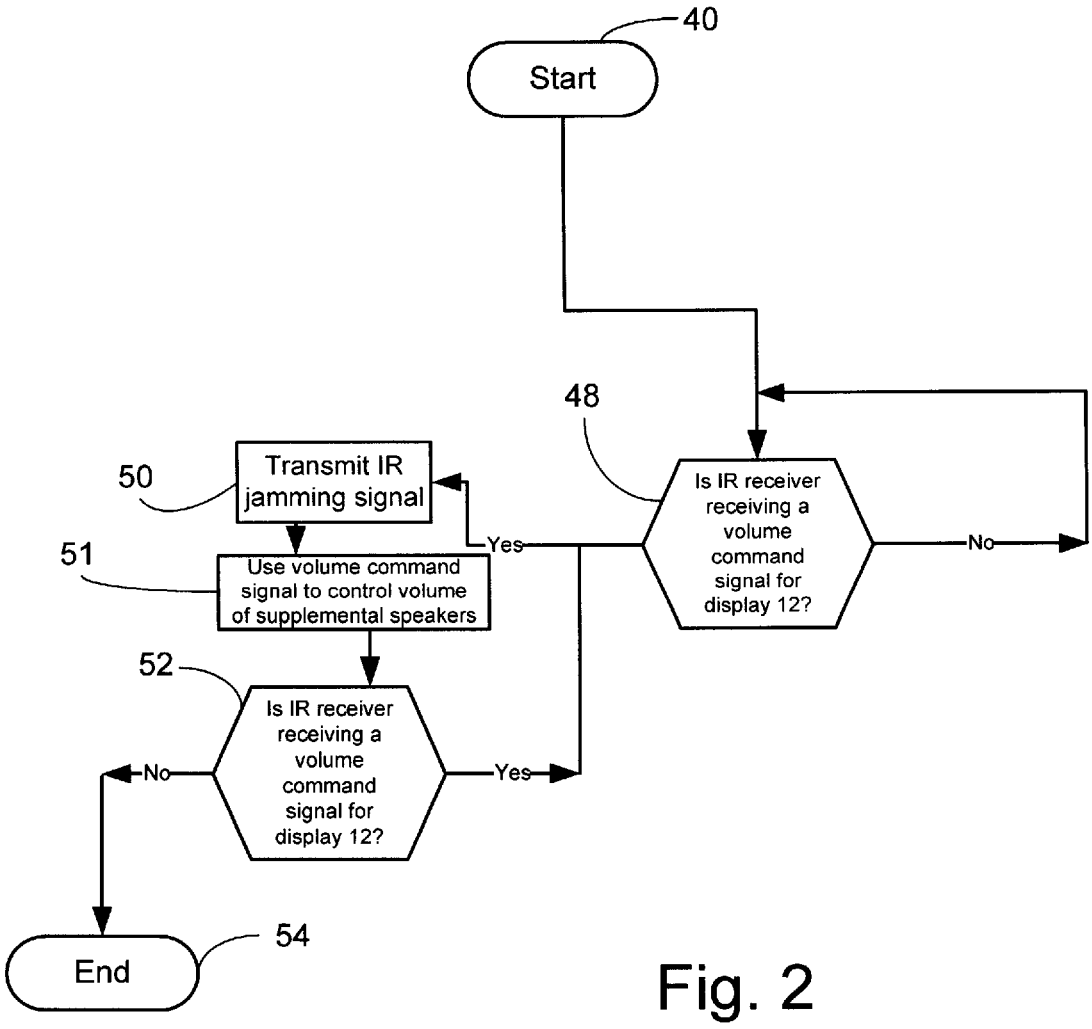
FIG. 2 is a flow diagram of a logic sequence used by the audio system in FIG. 1.

Referring to FIGS. 1 and 2, a logic flow used by controller 15 of receiver 14 will be described which relates to controlling and coordinating the sound level that is output by supplemental speaker system 26. At a step 40 the subroutine starts. At a step 48 the controller 15 checks to see if the IR receiver 23 is receiving a wireless IR volume command signal (e.g. volume up, volume down, mute) from the remote 31 that is intended to be received by IR receiver 17 to change the sound level output by speakers 13 in display 12. When controller 15 determines that IR receiver 23 is receiving the vol. signal, controller 15 causes a wireless IR jamming signal to be transmitted from IR transmitter 27 at a step 50 which prevents the display 12 from responding to the IR volume command sent from the remote control 31. As such, the sound level output by each speaker 13 is not changed. At a step 51 the controller 15 uses information in the volume command signal received from remote control 31 to change the sound output (e.g. up, down, mute) by supplemental speaker system 26. In the event a user wants to listen to speakers 13 only and not use the supplemental speaker system 26, a power off button (not shown) on receiver 14 is pressed. In this case the subroutine of FIG. 2 is not executed and speakers 13 are controlled in a normal manner by remote control 31 (if the speakers 13 were turned off they would need to be turned back on by the user). IR jamming is done as follows.

Figure 3:
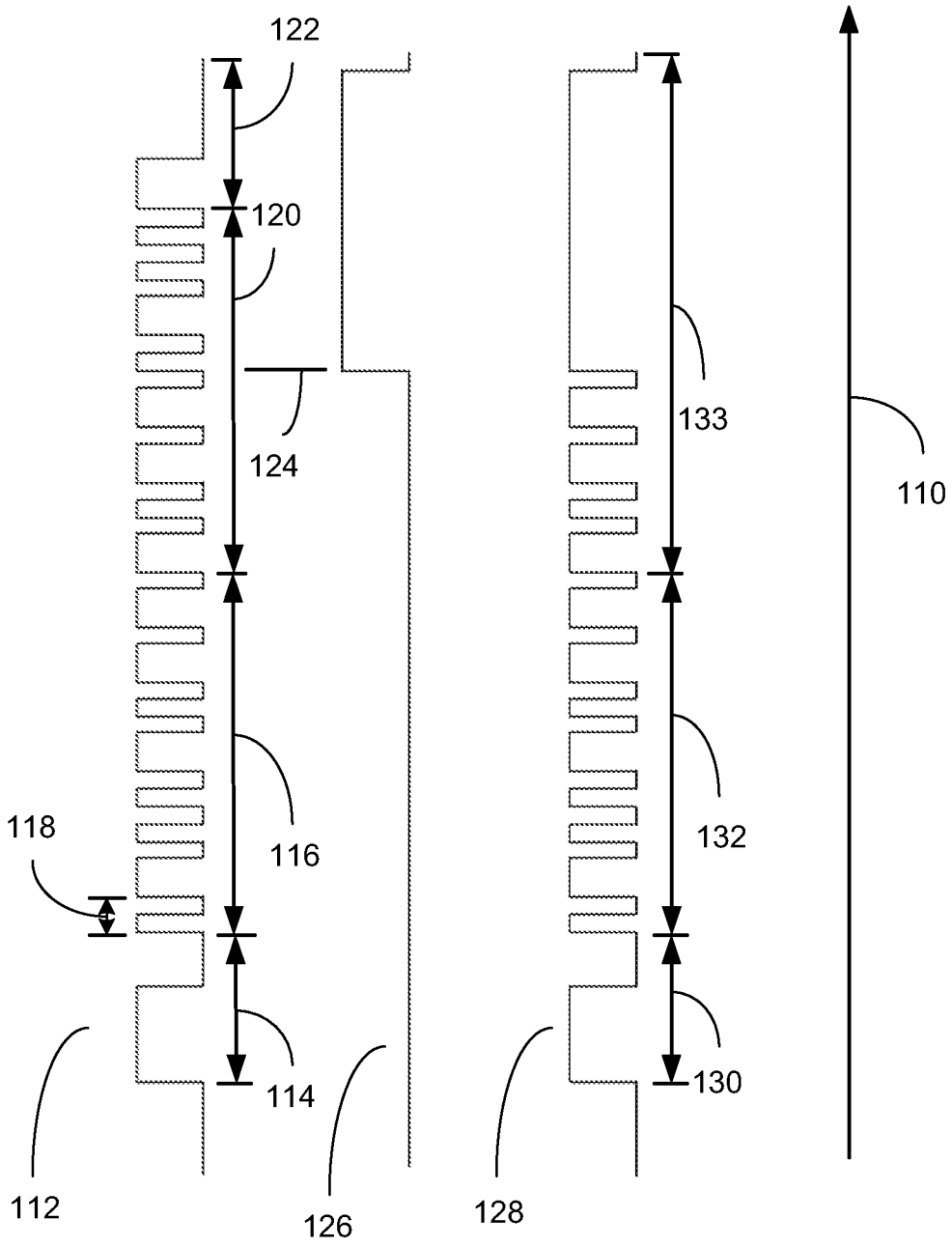
FIG. 3 shows a series of three signals.

Turning to FIG. 3, the composition of a typical IR signal will be explained along with a discussion of how to jam an IR signal. Axis 110 represents time, A first wireless IR signal 112 is issued by, for example, remote control 31 (FIG. 1) and contains an original message (e.g. volume down). The signal 112 (or package) includes a header 114, a databyte 116 composed of a number of data bits 118, a data byte checksum 120 and a stop bit 122. It is possible for controller 15 to recognize the IR message before the entire IR package transmission is complete. For example, at a point 124 in time the controller 15 understands with high confidence the message content (e.g. volume down) even though the entire transmission has not been completed (the last portion of the data byte checksum 120 and the stop bit 122 have not yet been transmitted). That is, the portion of the signal 112 that contains the information that identifies which command the signal pertains to has been completely received prior to time 124. The checksum and stop bit have not yet been received, but these are not required to understand the information in the data byte. They only help improve the reliability of the detection by the display. In addition, controller 15 can be configured to recognize the command information before the display circuitry recognizes the command because the wireless communication system including the remote control and the display will often rely on successful transmission of the same message multiple times before the display confirms the command and takes action. Controller 15 can be configured to act as soon as it has received the message a single time, thus ensuring it can take a subsequent action before the display is ready to act on the signal output by the remote.

As soon as the message is recognized as one that should be jammed (e.g. a volume down message), the controller 15 causes the IR transmitter 27 to issue a disturbing IR stream 126 which alters the last part of the data byte checksum 120 and the stop bit 122 for a particular IR package. Notice that the disturbing IR transmission stream 126 is not commenced until the point in time 124. This prevents the IR receiver 17 of display 12 from receiving the entire IR package. For example, a signal 128 represents what the IR receiver 17 receives and includes the header 130 and the data byte 132. However, because the IR receiver 17 only receives part of the data byte checksum, the checksum fails. (The checksum is a process running on the controller of the display 12. It calculates a value from the data bits received and compares it to the checksum data. If they match, it assumes the data was received without error. If there is not a match, the display's controller determines there was an error and does not execute the command. As a result, the display 12 does not react to the partially received IR package and there is no attempt to change the volume of speakers 13. All that is required for this system to function well, is to detect the message prior to the last bit being transmitted from the original IR package and immediately issue the jamming signal.

If the IR receiver 23 receives an IR signal (e.g. a channel up signal) for which there is no desire to interfere, then a jamming signal is not transmitted. In effect, the IR receiver 17 receives a plurality of receivable wireless signals that are intended to control functions (e.g. channel up, volume down, mute, pause etc.) of the video display 12. The IR transmitter transmits a wireless signal that prevents a subset (e.g. volume down, mute) of the plurality of receivable wireless signals from controlling the video display 12.

As an alternative to issuing a jamming signal, the IR transmitter 27 can issue an IR command signal to counter the signal that was received by IR receiver 23. For example, if the IR receiver 23 receives a volume up command from remote control 31 of a certain duration, then controller 15 causes the IR transmitter 27 to issue a volume down command of similar duration.

There are different ways in which to jam the IR receiver 17. One way is to blast a large IR carrier signal from IR transmitter 27 into the room in which the display 12 is located for a short period of time (e.g. a few milliseconds). In this case, the location of the IR transmitter 27 does not matter much but the entire environment is polluted with the jammer signal. The IR receiver 23 will also get briefly jammed, but the controller 15 already understands the IR volume message and so can control the output of speaker system 26. An alternative to blasting a large IR carrier signal with IR transmitter 27 is to use a low energy IR dongle that is positioned near the IR receiver 17. With this alternative the IR dongle should be positioned such that no other IR controlled device in the vicinity is disturbed by the large IR jammer signal, including receiver 23. This positioning of the IR dongle is preferably near the IR receiver 17. The jamming signal should be selected so as to avoid switching other devices in the system to an undesired state.

There are several ways to select the desired IR codes (e.g. for volume commands) used to identify commands to be jammed that are issued by a remote control. One way is to hard code into the memory associated with controller 15 at manufacturing time the IR codes to be jammed, for example, the vol. command codes from the most popular TV, satellite box and cable box models. When an IR transmission begins to be received by IR receiver 23, controller 15 sees if the received IR code matches any of the stored IR codes. When an IR code match is determined, jamming of the IR transmission is commenced. Another way to select the desired IR codes is to use the reverse lookup techniques described in US Patent Publications 2008051294 and 20080174467, and U.S. patent application Ser. No. 12/190,480 which are all incorporated herein by reference. A further way to select the desired IR codes is to dynamically teach the controller 15 and IR transmitter 27 the desired codes at installation time. With this method, receiver 14 stores a large number of IR codes for different types of devices (e.g. video displays). During initial setup of the receiver 14, the controller 15 is taught which set of IR codes are used to control volume up, volume down, mute, etc. for video display 12 (the Bose® Lifestyle® 48 DVD Home Entertainment System operates in this way). One more way to select the desired IR codes is through a learning mode in which the TV remote 31 is pointed at the receiver 23. The user is then instructed to press certain controls on the remote 31, and the controller 15 learns the codes, A further benefit of the example described above is as follows. With some video displays, when the integrated speakers are turned off or set to mute, the words "Speakers Off" or "Mute" will be presented on the display when the remote control vol. buttons are operated. Showing the words "Speakers Off" or "Mute" on the display does not make sense when the supplemental audio system is playing audio out loud. By jamming the remote control volume commands, the display will not present the words "Speakers Off" or "Mute".

Figure 4:
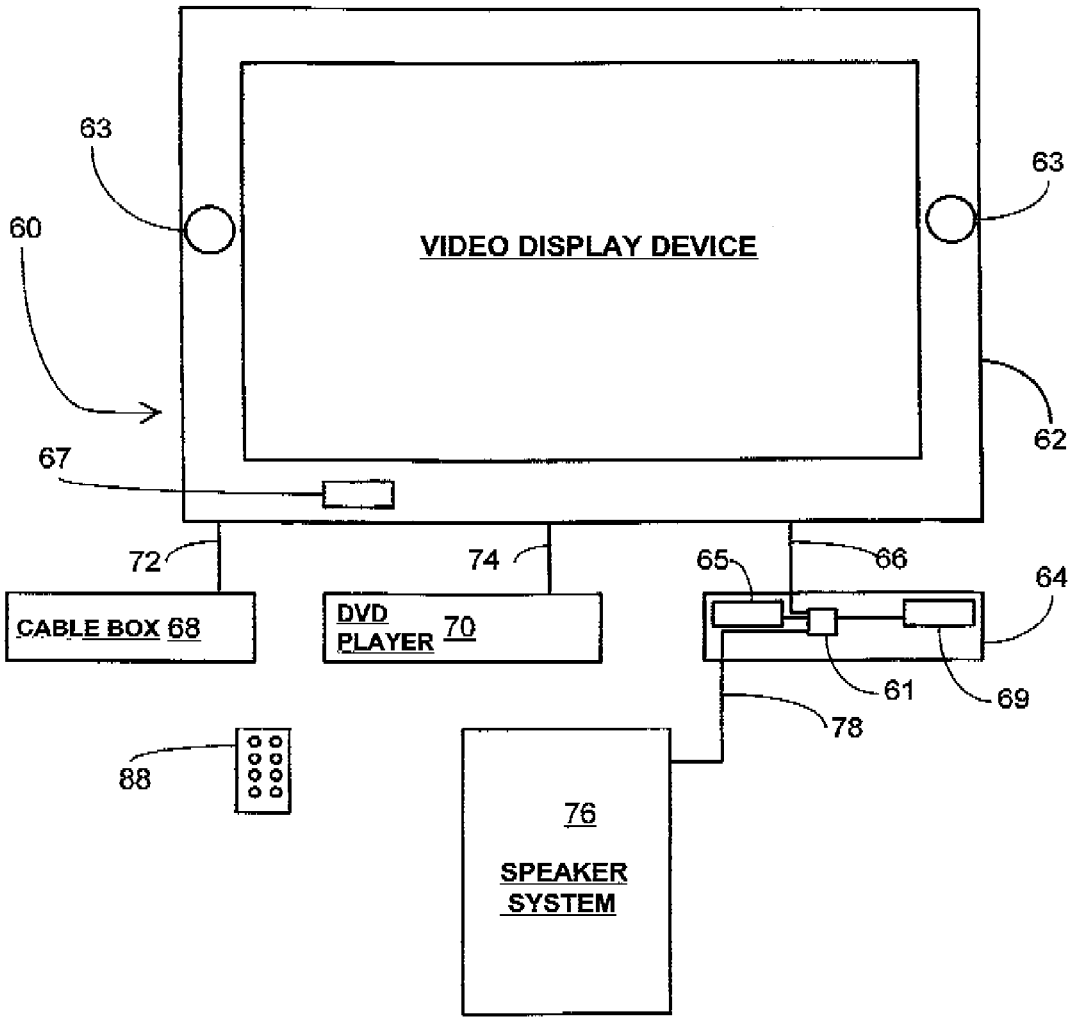
FIG. 4 is a schematic representation of another type of audio video system.

FIG. 4 discloses another embodiment of an audio/video system 60 which includes a video display device 62 such as a liquid crystal or plasma display. The display 62 includes integrated speakers (acoustic drivers) 63 and an infra-red (IR) receiver 67. In this embodiment, use is made of a source switching capability included in the display 62. By making use of this functionality, it is not necessary to include the source switching in an associated controller 61 for the auxiliary sound system, and its cost can be reduced. In the example shown in FIG. 1, the controller 15 was controlling the A/V source switching. Additionally, in this embodiment, the user is not instructed to disable the integrated speakers 63 as the system ensures that speakers 63 are always turned down, preferable to zero volume. This is accomplished as described below.

The controller 61 in an interface module 64 is connected to the video display device 62 by, for example, a digital optical cable 66. As such, audio from the display device 62 can be transmitted to the module 64. When the module 64 is receiving audio signals from the display 62, the controller 61 in the module 64 knows that display 62 is powered on. The controller 61 is also connected to an IR receiver 65 and an IR transmitter 69 in the module 64.

A pair of audio/video devices, such as a cable box 68 and a digital video disc (DVD) player 70, are attached to the display 62 by, for example, respective HDMI cables 72 and 74. A supplemental speaker system 76 is connected to the interface module 64 by a cable 78. Again, the supplemental speaker system can be in the form of any type of speaker system as discussed above (e.g. 7.2, 7.1, 5.1 etc.). The controller 61 controls operation of the module 64. A wireless remote control 88, associated with video display 62, can issue wireless signals (preferably IR) for controlling operation of the video display 62.

Figure 5:
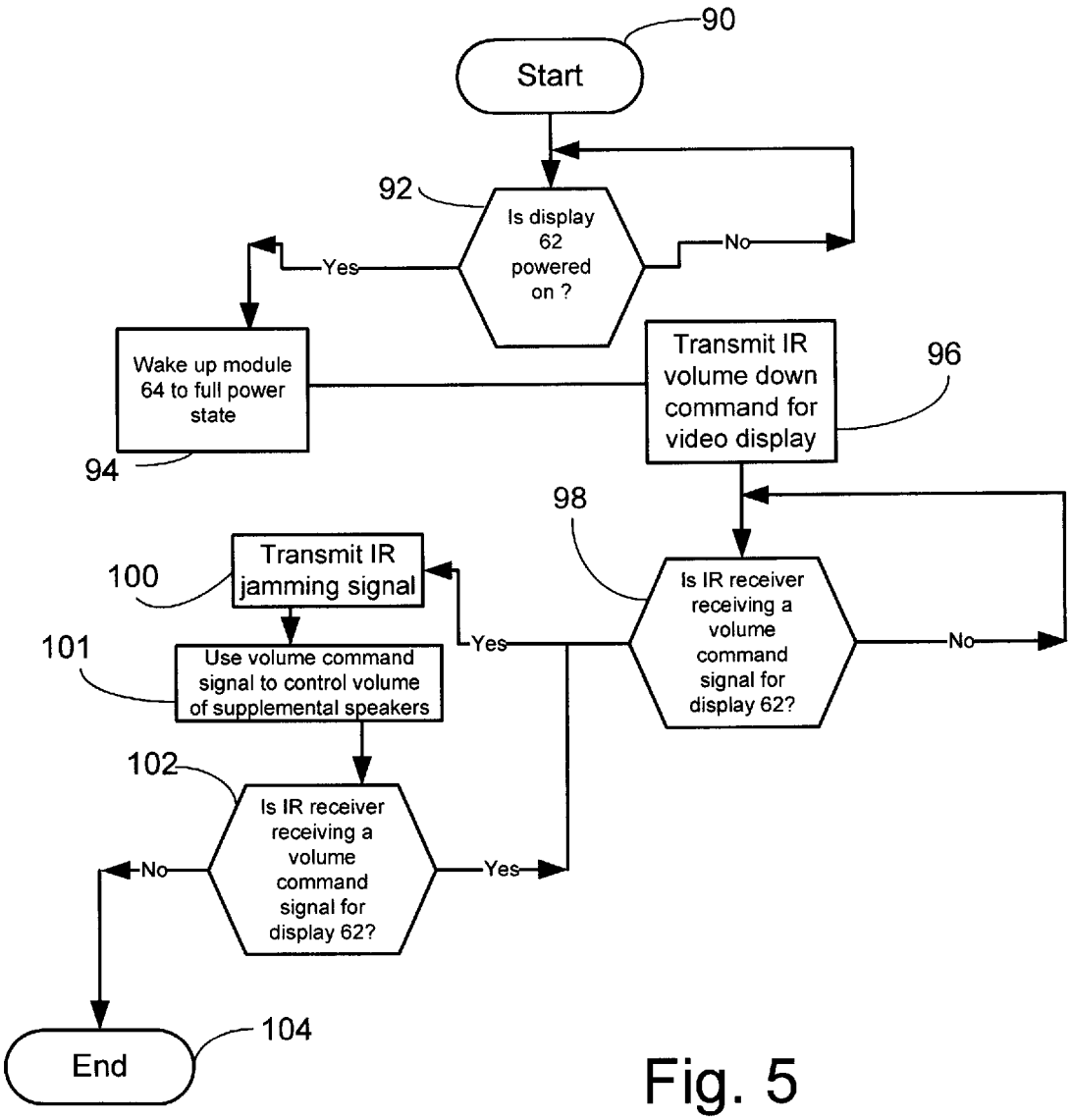
FIG. 5 is a flow diagram of a logic sequence used by the audio system in FIG. 3.

Referring to FIGS. 4 and 5, a logic flow used by the controller 61 of the module 64 will be described which relates to controlling and coordinating the sound level that is output by speakers 63 and 76. At a step 90 the subroutine starts. At a step 92 the controller 61 checks to see if the display 62 has been powered on. One way to do this is to see if audio is being received by the controller 61 from the display 62 over cable 66. Other methods of determining whether or not the display 62 is powered on may be used. After the display 62 has been powered on, the controller 61 brings the module 64 to a full power state at a step 94. The controller 61 then causes IR transmitter 69 to transmit a wireless volume down command signal to the IR receiver 67 of the video display 62 at a step 96. This signal is transmitted for a period of time (e.g. 5 seconds) to cause the sound level of speakers 63 to be lowered, preferably to a lowest level (e.g. off). The way in which the volume down command signal is obtained was explained above.

At a step 98 the controller 61 checks to see if the IR receiver 65 is receiving an IR volume command signal (e.g. volume up, volume down, mute) from the remote 88 that is intended to also be received by IR receiver 67 to control the sound level of speakers 63 in display 62. When the controller 61 determines that the IR receiver 65 is receiving an IR volume command signal, the controller 61 causes an IR jamming signal to be transmitted from IR transmitter 69 at a step 100 which prevents the display 62 from responding to the IR volume command sent from the remote control 88. At a step 101 the logic 61 uses the volume command signal received from remote control 88 to control the volume (e.g. up, down, mute) of the supplemental speaker system 76.

Figure 6:
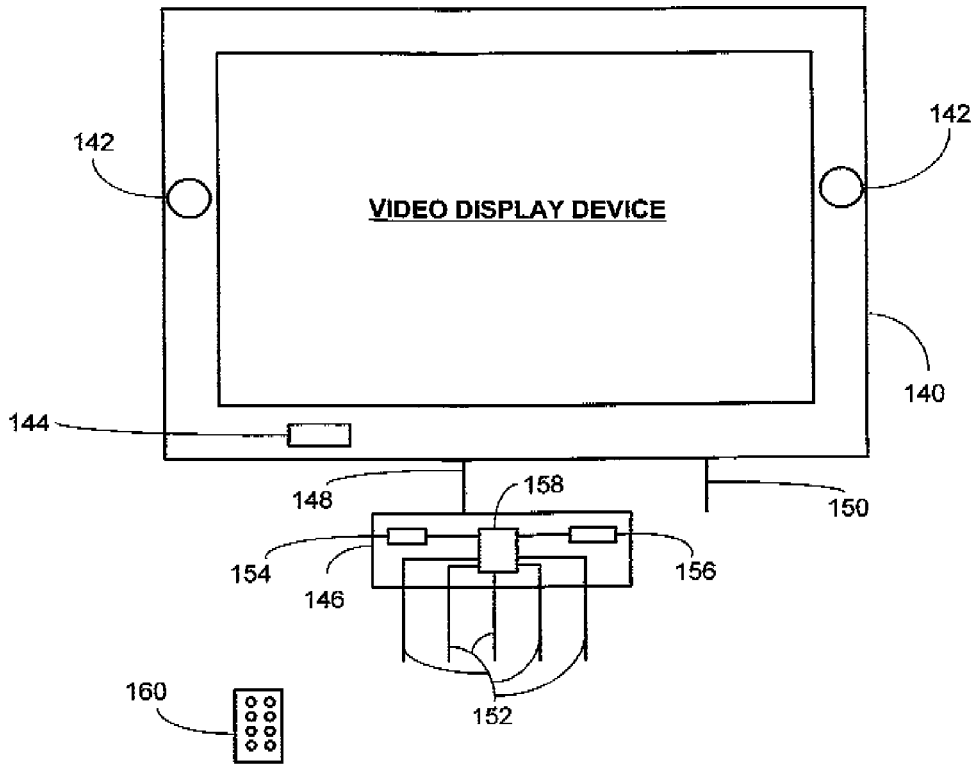
FIG. 6 is a schematic representation of yet another type of audio video system.

Turning to FIG. 6, another example will be discussed in which the selection of an audio/video input to a video display is being controlled instead of the sound level output by various speakers. A video display device 140 includes integrated speakers 142 and an IR receiver 144. An audio/video (A/V) input expander 146 is connected to a first AV input of the display 140 by, for example, an HDMI cable 148 which transmits audio and video signals from the expander 146 to the display 140. The display 140 also has a second A/V input 150 which is not utilized in the situation. The video display 140 is set to the first input 148. In one embodiment, the expander 146 has five A/V inputs 152 which can be connected to various A/V sources (not shown) such as a DVD player, a cable box, a satellite box, a video game system, etc. (though any number of inputs could be accommodated). This arrangement expands the two original A/V inputs of the display 140 to a total of six A/V inputs.

The expander 146 also includes an IR receiver 154 and an IR transmitter 156 which are both connected to a controller 158. The inputs 152 are also connected to the controller 158. A wireless IR remote control 160 associated with the display 140 can be operated by a user to issue IR commands to control various operations of the display 140. When the controller 158 determines that the display 140 has been powered on (e.g. by sensing incoming audio and video on one or more of the A/V inputs 152), the logic wakes up the expander 146 from a low power state to a power on state. It should be noted that detecting that the display power is on is not necessary as part of a system (e.g. expander 146) that switches inputs (this is true for the example shown in FIG. 1 also where input switching can be controlled by controller 15). When a user operates the remote control 160 to advance the video display 140 to a next A/V input, the IR receiver 154 picks up this IR command and passes it to the controller 158. Once the controller 158 recognizes this IR command as one to change the A/V input to the display 140, the controller 158 causes the IR transmitter 156 to issue an IR jamming signal as discussed above. This jamming signal prevents the IR receiver 144 from receiving the entire IR command, and so the display 140 does not advance the A/V input from input 148 to input 150. The controller 158 also advances the A/V input to the expander 146 from one of the A/V inputs 152 to another of these inputs. The audio and video information from the newly selected A/V input 152 is passed by the controller 158 to the display 140 which presents the audio and video to the user.

If the user operates the remote control 160, for example, to call up the main menu for the display 140, the controller 158 will recognize that this command should not be jammed and allows the full command to be received by the IR receiver 144. The main menu for the display 140 will then be presented. In effect, the IR receiver 154 receives a plurality of receivable wireless signals that are intended to control functions (e.g. change A/V input, present main menu etc.) of the video display 140. The IR transmitter 156 transmits a wireless signal that prevents a subset (e.g. change A/V input) of the plurality of receivable wireless signals from controlling the video display 140, and thus controller 158 may execute commands originally intended for display 140.

While the disclosure above has been particularly shown and described with reference to specific exemplary embodiments, it is evident that those skilled in the art may now make numerous modifications of, departures from and uses of the specific apparatus and techniques herein disclosed. For example, although the examples described above relate to A/V devices in an A/V system, the teachings apply to any electronic system having two or more wireless devices. Consequently, the disclosed subject matter is to be construed as embracing each and every novel feature and novel combination of features presented in or possessed by the apparatus and techniques herein disclosed and limited only by the spirit and scope of the appended claims.

What is claimed is:

1. A method of controlling an electronic system, comprising the steps of:

receiving by a first device a plurality of receivable wireless signals that are intended to control functions of a video display device with integrated speakers;

transmitting by the first device a wireless signal that prevents a subset of the plurality of receivable wireless signals from controlling the video display device; and utilizing information in the subset of the receivable wireless signals to change a sound level output from a supplemental speaker system that can play audio that can also be played by the integrated speakers of the video display device.

2. The method of claim 1, wherein the plurality of receivable wireless signals are infrared signals.

3. The method of claim 1, wherein the wireless signal is an infrared signal.

4. The method of claim 1, further including the step of automatically lowering a sound level output by the integrated speakers of the video display device.

5. The method of claim 4, wherein the lowering step is done before the receiving and transmitting steps.

6. The method of claim 1, wherein the subset of the plurality of receivable wireless signals comprises a signal far controlling a sound level output of the integrated speakers of the video display device.

7. The apparatus of claim 1, wherein the plurality of receivable wireless signals are infrared signals.

8. The apparatus of claim 1, wherein the wireless signal from the transmitter is an infrared signal.

9. The apparatus of claim 1, further including a controller which automatically lowers a sound level output by the integrated speakers of the video display device.

10. The apparatus of claim 9, wherein the lowering of the sound level output by the integrated speakers of the video display device is done before the receiver receives the plurality of receivable wireless signals.

11. The apparatus of claim 9, wherein the lowering of the sound level output by the integrated speakers of the video display device is done before the transmitter transmits the wireless signal that prevents the subset of the plurality of receivable wireless signals from controlling the video display device.

12. The method of claim 1, further including the step of utilizing information in the subset of the plurality of receivable wireless signals to change an audio/video input to the video display device.

13. An apparatus for controlling an electronic system, comprising:

a receiver of a first device for receiving a plurality of receivable wireless signals that are intended to control functions of a video display device with integrated speakers;

a transmitter of the first device for transmitting a wireless signal that prevents a subset of the plurality of receivable wireless signals from controlling the video display device;

a supplemental speaker system configured to play audio that can also be played by the integrated speakers of the video display device; and a controller which utilizes information in the subset of receivable wireless signals to change a sound level output of the supplemental speaker system.

14. The apparatus of claim 13, wherein the subset of receivable wireless signals comprises a signal for controlling a sound level output of the integrated speakers of the video display device.

* * * * *